US007327125B2

(12) United States Patent
Benbrik

(10) Patent No.: US 7,327,125 B2
(45) Date of Patent: Feb. 5, 2008

(54) POWER SUPPLY CIRCUIT HAVING VOLTAGE CONTROL LOOP AND CURRENT CONTROL LOOP

(75) Inventor: Jamel Benbrik, Colorado Springs, CO (US)

(73) Assignee: QUALCOMM Incorporated, San Diego, CA (US)

( * ) Notice: Subject to any disclaimer, the term of this patent is extended or adjusted under 35 U.S.C. 154(b) by 206 days.

(21) Appl. No.: 11/061,718

(22) Filed: Feb. 17, 2005

(65) Prior Publication Data

US 2006/0181258 A1 Aug. 17, 2006

(51) Int. Cl.
*G05F 1/59* (2006.01)

(52) U.S. Cl. ..... 323/269; 323/277

(58) Field of Classification Search ..... 323/269, 323/273, 275, 277
See application file for complete search history.

(56) References Cited

U.S. PATENT DOCUMENTS 3,675,114 A * 7/1972 Nercessian ..... 323/269
4,920,309 A * 4/1990 Szepesi ..... 323/269
5,258,653 A * 11/1993 Perry ..... 307/74
5,629,609 A 5/1997 Nguyen et al.
6,353,309 B1 3/2002 Ootani et al.
6,654,264 B2 * 11/2003 Rose ..... 363/65
7,106,032 B2 * 9/2006 Chen et al. ..... 323/269

FOREIGN PATENT DOCUMENTS

WO WO03102709 12/2003

* cited by examiner

*Primary Examiner*—Jeffrey Sterrett
(74) *Attorney, Agent, or Firm*—Howard H. Seo; William Marcus Hooks; Thomas Rouse

(57) ABSTRACT

A power supply circuit includes two pass transistors that conduct current from a voltage supply terminal to an output terminal. One of the pass transistors is smaller whereas the other is larger. Current through the smaller transistor is controlled by the voltage control loop such that the voltage on the output terminal is regulated to a predetermined voltage. Current through the larger transistor is controlled by a high gain current control loop such that the current flowing through the larger transistor is a multiple of the current flowing through the smaller pass transistor. By reducing current flow in the smaller transistor, the power supply rejection ratio (PSRR) of the power supply circuit is improved for frequencies up to 100 kHz. Die space occupied by the two pass transistors is reduced in comparison to the amount of pass transistor die space in a conventional power supply circuit of similar performance.

25 Claims, 7 Drawing Sheets

OPERATIONAL
CURRENT AMPLIFIER

SMALL SIGNAL MODEL

VOLTAGE LOOP STABILITY

CURRENT LOOP STABILITY

EQUIVALENT PASS DEVICE

| PERFORMANCE PARAMETER | VALUE |
|---|---|
| IDDQ (LPM/HPM/LOAD) | 11uA/50uA/0.5% |
| LOAD REG | 0.65% |
| LINE REG | 0.2%/V |
| PSRR | - 70dB |
| PSRR@ 100 kHZ | - 65dB |
| ERROR | 2% |
| DROPOUT | 300mV |
| PASS DEVICE (W/L 300mA) | 20k (14mm/0.7um) |

PSRR VERSUS FREQUENCY

POWER SUPPLY CIRCUIT HAVING VOLTAGE CONTROL LOOP AND CURRENT CONTROL LOOP

BACKGROUND

1. Field

The disclosed embodiments relate generally to power supply circuits.

2. Background

FIG. 1 (Prior Art) is a circuit diagram of a conventional power supply circuit 1 that supplies power to an external load 2. Power supply circuit 1 receives power from a battery (not shown) via VBAT voltage supply terminal 2 and ground terminal 3. Power supply circuit 1 outputs a desired output voltage VOUT onto output terminal 4. A bandgap voltage reference 5 outputs a reference voltage VREF such as, for example, 1.2 volts. A resistor divider made up of resistor 6 and resistor 7 divides the voltage VOUT on output node 4 such that when a desired voltage (for example, 4.0 volts) is present on output node 4 then the voltage VREF will be present on node 8. A differential amplifier 9 compares the reference voltage VREF to the voltage on node 8 and drives the voltage on the gate of transistor 10 accordingly. The current flowing from drain to source within transistor 10 is mirrored by transistor 11 and a large pass transistor 12 such that a proportional current flows from the VBAT terminal 2 the through pass transistor 12 to output terminal 4. If the current flowing through pass transistor 12 to output terminal 4 is too small such that the voltage on node 8 is less than reference voltage VREF, then differential amplifier 9 increases the voltage on the gate of transistor 10 such that the current flowing through pass transistor 12 increases until the voltage on node 8 matches the reference voltage VREF. If, on the other hand, the current flowing through pass transistor 12 to output terminal 4 is too large such that the voltage on node 8 is higher than the VREF, then differential amplifier 9 decreases the voltage on the gate of transistor 10 such that the current flowing through pass transistor 12 decreases until the voltage on node 8 matches VREF. The voltage on output terminal 4 is therefore regulated by a voltage control loop.

In some applications, noise may be present on the battery voltage VBAT due to multiple circuits in addition to power supply circuit 1 being coupled to the same battery. If, for example, the battery voltage VBAT were to drop momentarily from the desired 4.0 volt supply voltage, down to 3.0 volts, and then return back up to the desired 4.0 volts, then this momentary drop in VBAT should not be translated into a corresponding momentary change in the supply voltage VOUT supplied onto output terminal 4. A radio frequency (RF) die that has sensitive radio frequency circuitry for a cell phone may, for example, receive power from output terminal 4. The 4.0 volts supplied from output terminal 4 is to remain constant despite momentary fluctuations in battery supply voltage VBAT.

The ability of the power supply circuit to output a constant output voltage VOUT despite a change in its input voltage VBAT is measured by a quantity called power supply rejection ratio or PSRR. The PSRR of a power supply circuit, in units of dB, is determined by dividing the variation seen in the output voltage VOUT by the variation in the input voltage VBAT, and then taking the logarithm of this quotient, and then multiplying the resulting value by 20. In general, the higher the gain of the voltage control loop, the better the PSRR (a better PSRR means that the PSRR number is a larger negative number). The PSRR of the power supply circuit, however, is frequency dependent. The voltage control loop responds well to low frequency changes in the input voltage VBAT. For faster changes in the input voltage VBAT, however, the control loop may be undesirably slow such that VBAT variations are communicated through the power supply circuit and are introduced into the output voltage VOUT. In the cell phone application described above where a sensitive RF die is powered by the power supply circuit, a PSRR rejection of −40 dB or better is desired for input voltage frequency variations from zero Hz up to 100 kHz.

One limitation on the speed of the voltage control loop is the size of pass transistor 12. Pass transistor 12 is generally made to be large so that the power supply circuit 1 can supply the desired amount of supply current to load 2. In one example of the circuit of FIG. 1, pass transistor 12 is made approximately 48 millimeters wide by 0.4 micrometers long (W/L=120,000) so that the power supply circuit can source a needed 300 mA of supply current in a cell phone application. Pass transistor 12 therefore occupies several square millimeters of die space. In addition to occupying an undesirably large amount of die space, the large size of pass transistor 12 in the voltage control loop serves to slow the response of the voltage control loop such that the PSRR of the power supply circuit at 100 kHz is worse than it otherwise could be. An improved power supply circuit is desired.

SUMMARY INFORMATION

An integrated power supply circuit includes two pass transistors that conduct current from a voltage supply terminal VBAT to an output terminal. One of the pass transistors is smaller whereas the other is larger. Current through the smaller pass transistor M1 is controlled by the voltage control loop such that the output voltage VOUT on the output terminal is regulated to a predetermined voltage. Current through the larger pass transistor M2 is controlled by a current control loop such that the amount of current flowing through the larger pass transistor M2 is a multiple of the current flowing through the smaller pass transistor M1. Current flow through the larger pass transistor M2 changes in rough proportion to changes in current flow through the smaller pass transistor M1. The proportional relationship of the current flowing through larger pass transistor M2 to the current flowing through smaller pass transistor M1 is maintained for power supply circuit operating regimes where the combined current flow through transistors M1 and M2 exceeds approximately one milliampere. By reducing current flow in the smaller pass transistor M1, the power supply rejection ratio (PSRR) of the power supply circuit is improved. In one example, the PSRR is better than −65 dB (a better PSRR means that the PSRR number is a larger negative number) for frequencies up to 100 kHz. Die space occupied by the two pass transistors M1 and M2 is reduced in comparison to the amount of pass transistor die space in a conventional power supply circuit of similar performance or even inferior performance.

In one embodiment, the current control loop has a high gain and includes an operational current amplifier (OCA). In high load current conditions, the OCA and current control loop are operational and the larger pass transistor M2 takes a current load of the smaller pass transistor M1 as set forth above. In low current conditions, the OCA and current control loop are disabled, thereby reducing current consumption of the power supply circuit. Whether the power supply circuit is operating with its current control loop disabled or enabled is controlled by a digital ENABLE signal. The digital value of the ENABLE signal is controlled by writing an appropriate value into a corresponding bit in a register. The register is accessible from a bus such as, for example, the SBI bus within a cellular telephone.

The power supply circuit is usable to supply power to a circuit or to supply power to a rechargeable battery during recharging. Additional embodiments are described in the detailed description below. This summary does not purport to define the invention. The invention is defined by the claims.

DETAILED DESCRIPTION

Figure 1:
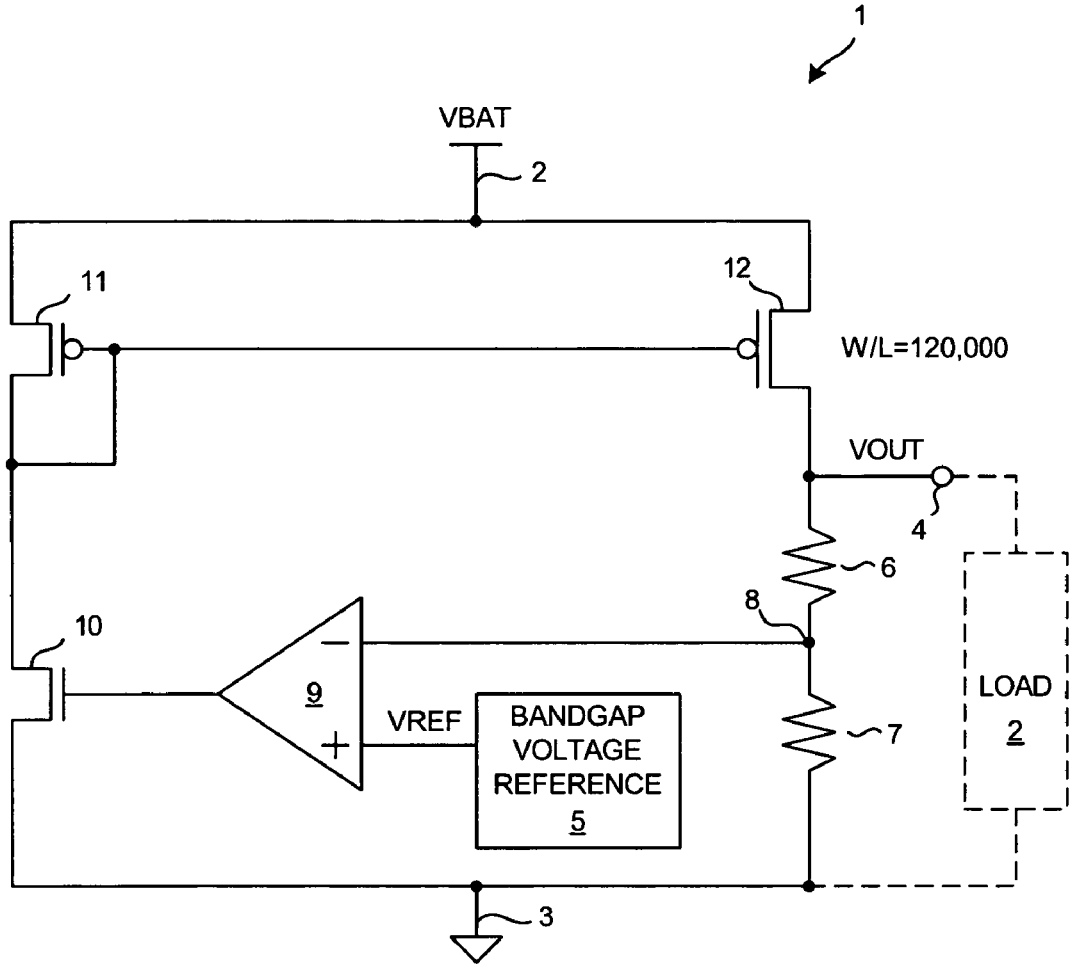
FIG. 1 (PRIOR ART)
FIG. 1 (Prior Art) is a diagram of a conventional power supply circuit.
Figure 2:
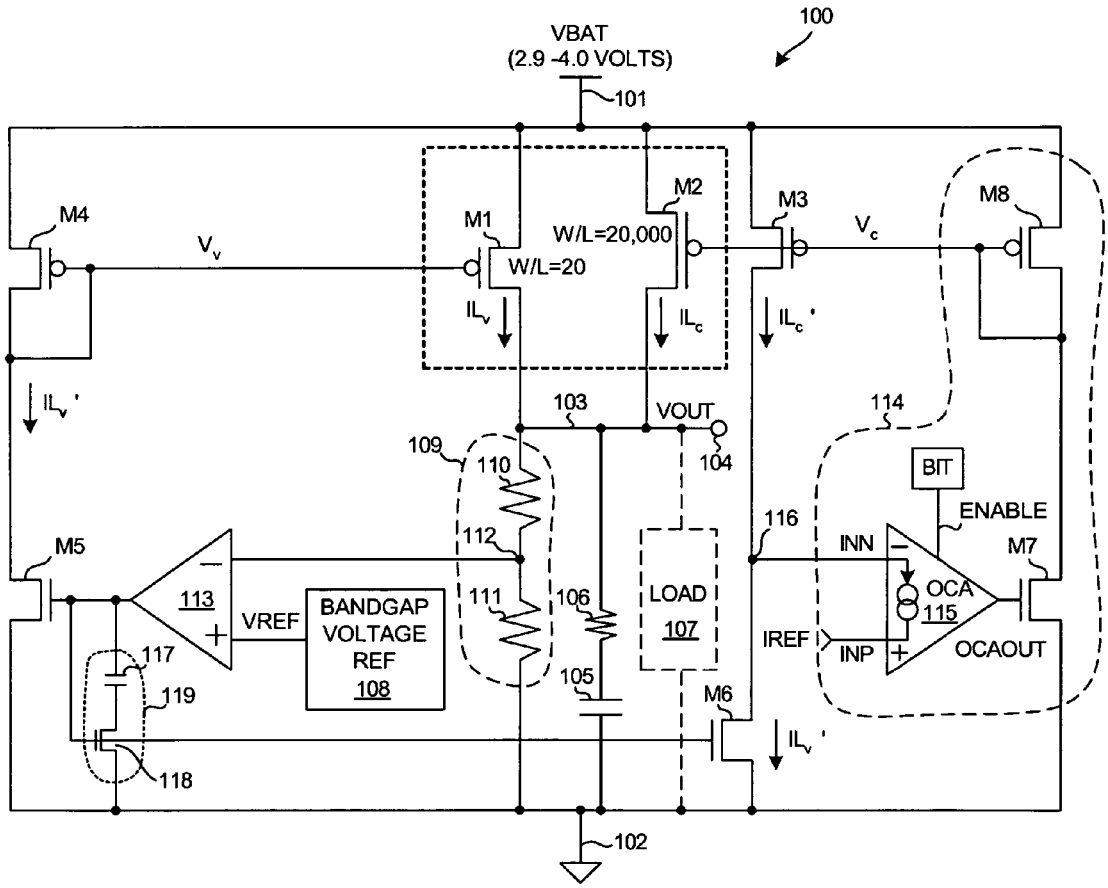
FIG. 2 is a simplified diagram of a power supply circuit 100 in accordance with one novel aspect.

FIG. 2 is a circuit diagram of a power supply circuit 100 in accordance with one embodiment. Power supply circuit 100 receives energy from an energy source such as a battery (not shown) via power supply terminal VBAT 101 and a ground terminal 102. Power supply circuit 100 supplies a regulated predetermined output voltage VOUT onto an output node 103 and an output terminal 104. In one embodiment, power supply circuit 100 is integrated onto a semiconductor integrated circuit die. Power supply circuit 100 operates with an external capacitor 105. Resistor 106 in the diagram of FIG. 1 represents the series resistance of external capacitor 105. Block 107 represents an external load that is powered by power supply circuit 100. In one embodiment, external load 107 is an integrated circuit, such as for example an integrated circuit upon which radio frequency (RF) circuitry is disposed. Both the power supply integrated circuit and the RF integrated circuit can be embodied in a cellular telephone.

Power supply circuit 100 includes a first pass transistor M1 and a larger second pass transistor M2. First pass transistor M1 is made to be relatively small (W/L=20) in order to increase the response speed of a voltage control loop that controls first pass transistor M1. The second pass transistor M2 is made to be relatively large (W/L=20,000) so that it supplies the majority of current that is needed to be supplied from power supply terminal VBAT 101 to output node 103 in order to keep the voltage on output node 103 and output terminal 104 regulated at the desired predetermined output voltage VOUT. A current control loop controls second pass transistor M2 so that the current $IL_c$ supplied by second pass transistor M2 to output node 103 is proportional to a control current within the voltage control loop. Provision of the larger second pass transistor M2 and the current control loop have additional advantages as set forth in further detail below.

Operation of the voltage control loop is as follows. A bandgap voltage reference 108 outputs a reference voltage VREF such as, for example, 1.2 volts. A resistor divider 109 made up of resistor 110 and resistor 111 divides the voltage VOUT on output node 103 such that when a desired voltage (for example, 2.6 volts) is present on output node 103, then the voltage VREF (for example, 1.2 volts) will be present on a sense node 112. A differential amplifier 113 compares the reference voltage VREF to the voltage on sense node 112 and sets the voltage on the gate of transistor M5 accordingly. The control current $IL_v'$ flowing from drain to source within transistor M5 is mirrored by transistor M4 and first pass transistor M1 such that a proportional first current $IL_v$ flows from the VBAT terminal 101, from source to drain through first pass transistor M1, and to output node 103. If the total current flowing through first pass transistor M1 and second pass transistor M2 from VBAT terminal 101 to output node 103 is too small such that the voltage on sense node 112 is less than reference voltage VREF, then differential amplifier 113 increases the voltage on the gate of transistor M5 thereby increasing the control current $IL_v'$ such that a first current $IL_v$ flowing through first pass transistor M1 increases until the voltage on sense node 112 matches the reference voltage VREF. If, on the other hand, the total current flowing through first pass transistor M1 and second pass transistor M2 from VBAT terminal 101 to output node 103 is too large such that the voltage on sense node 112 is higher than VREF, then differential amplifier 113 decreases the voltage on the gate of transistor M5 thereby decreasing control current $IL_v'$ such that the first current $IL_v$ flowing through first pass transistor M1 decreases until the voltage on sense node 112 matches VREF. The voltage on output node 103 is therefore regulated by the voltage control loop to maintain the predetermined output voltage VOUT.

Operation of the current control loop is as follows. The control current $IL_v'$ flowing from the drain to the source through transistor M5 is mirrored by a first current mirroring transistor M6. The gate of first current mirroring transistor M6 is coupled to the gate of transistor M5. The source of first current mirroring transistor M6 is coupled to the source of transistor M5. The drain to source current $IL_v'$ flowing through the first current mirroring transistor M6 is therefore proportional to the control current $IL_v'$ flowing through transistor M5. In the present example, the transistors M5 and M6 are the same size. The drain to source currents through the two transistors are therefore designated with the same symbol, $IL_v'$.

A second current mirroring transistor M3 is provided to mirror a second current $IL_c$. Second current $IL_c$ flows through second pass transistor M2 from the source of second pass transistor M2 to the drain of second pass transistor M2. The mirror current flowing through the second mirroring transistor M3 is denoted $IL_c'$. The gate of second current mirroring transistor M3 is coupled to the gate of second pass transistor M2. The source of second current mirroring transistor M3 is coupled to the source of second pass transistor M2. The magnitude of the second mirror current $IL_c'$ is therefore proportional to the magnitude of second current $IL_c$. In the present example, transistor M3 is much smaller than transistor M2. Second mirror current $IL_c'$ is approximately 1/100 of the second current $IL_c$.

The current control loop includes control circuitry 114. Control circuitry 114 controls a voltage $V_c$ on the gate of second current mirroring transistor M3 such that the second mirror current $IL_c'$ flowing through the second current mirroring transistor M3 is substantially equal to the first mirror current $IL_v'$ flowing through the first current mirroring transistor M6. This control circuitry 114 includes an operational current amplifier (OCA) 115 and two transistors M7 and M8. Operational current amplifier 115 has a positive (non-inverting) input lead INP, a negative (inverting) input lead INN, an enable input lead ENABLE, and an output lead OCAOUT. Output lead OCAOUT is coupled to the gate of transistor M7. If the magnitude of second mirror current $IL_c'$ flowing through second current mirroring transistor M3 is greater than the magnitude of first mirror current $IL_v'$ flowing through first mirroring transistor M6, then current flows from node 116 into the negative input lead INN of operational current amplifier 115. The voltage on the gate of transistor M7 is reduced, thereby reducing drain to source current flow through transistor M7. The drain to source current flow through transistor M7 is the source to drain current flow through transistor M8. The source to drain current flow through transistor M8 is in turn mirrored by second current mirroring transistor M3 such that the current flow $IL_c'$ is proportional to the source to drain current flow through transistor M8. The second mirror current $IL_c'$ is therefore reduced until it equals the first mirror current $IL_v'$. The current control loop involving operational current amplifier 115, transistor M7, transistor M8, and second current mirroring transistor M3 operates to keep the magnitude of the second mirror current $IL_c'$ equal to the magnitude of the first mirror current $IL_v'$.

Because the gate of second pass transistor M2 is coupled to the gate of second mirroring transistor M3 and because the source of second pass transistor M2 is coupled to the source of second mirroring transistor M3, the second current $IL_c$ is proportional to the second mirror current $IL_c'$. In this example, the second mirror current $IL_c'$ is approximately 1/100 of the second current $IL_c$. The magnitude of the second current $IL_c$ is therefore controlled by the current control loop to be proportional to the magnitude of the control current $IL_v'$ flowing through transistor M5 in the voltage control loop. This proportionality is maintained where the total load current flowing through pass transistors M1 and M2 exceeds approximately one milliampere. The larger the control current $IL_v'$ in the voltage control loop, the larger the second current $IL_c$. The current control loop therefore serves to reduce the amount of current that needs to flow through first pass transistor M1 in order for the power supply circuit 100 to supply a given amount of current from output terminal 104. By reducing the amount of current that needs to be conducted through first pass transistor M1, first pass transistor M1 can be made smaller. By making first pass transistor smaller, the gate capacitance of first pass transistor M1 in the voltage control loop can also be made smaller, thereby increasing the speed of the voltage control loop in comparison to the prior art circuit of FIG. 1.

Figure 3:
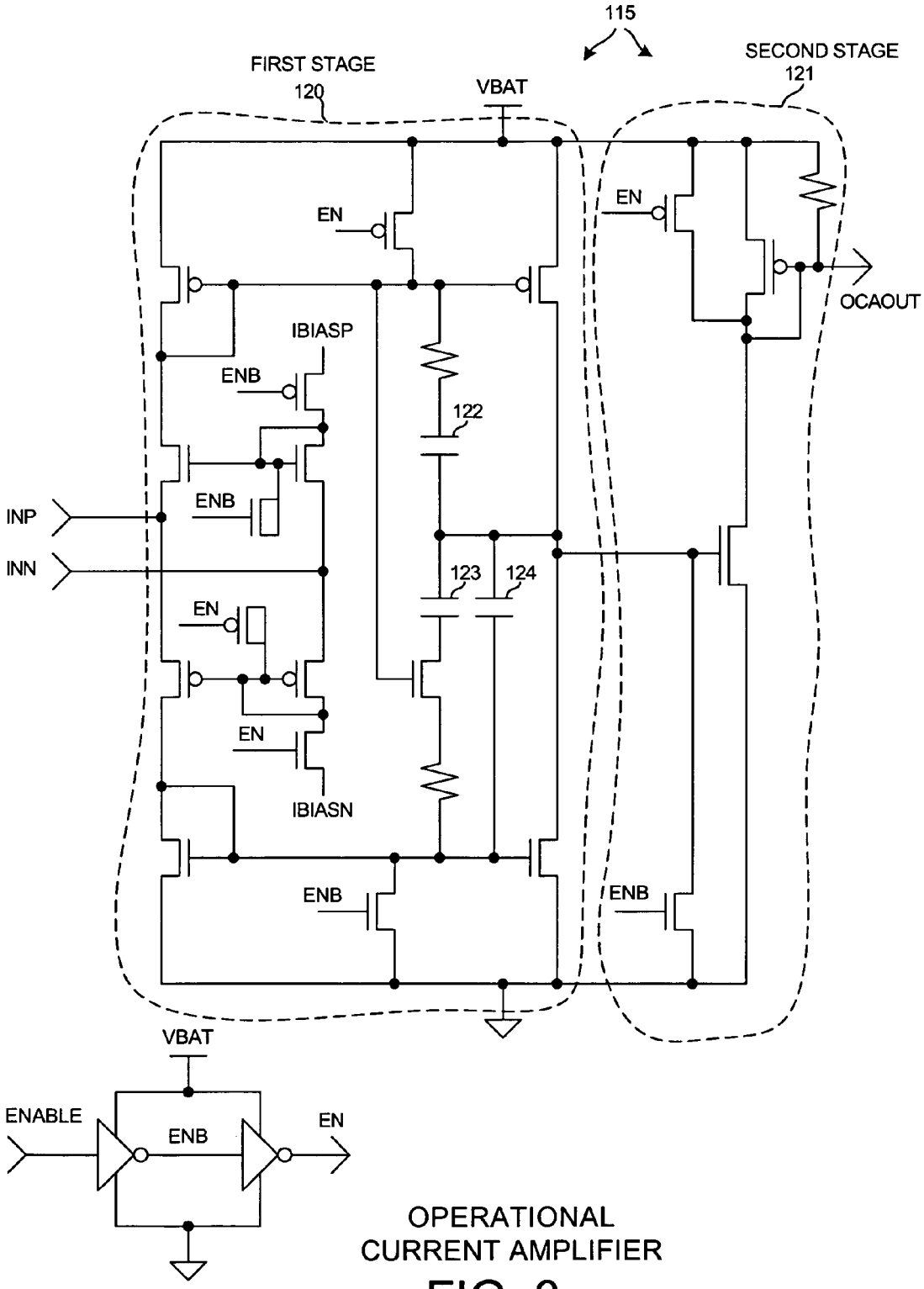
FIG. 3 is a simplified diagram of the operational current amplifier (OCA) of the power supply circuit 100 of FIG. 2.

FIG. 3 is a circuit diagram of one example of operational current amplifier 115 of FIG. 2. Operational current amplifier 115 includes a first stage 120 and a second stage 121. The capacitors 122-124 are realized as poly-plate substrate capacitors. The power supply circuit 100 of FIG. 2 has a high power mode and a low power mode. In the high power mode, operational current amplifier 115 is powered such that the current control loop causes second pass transistor M2 to supply current onto output node 103. In this mode, power supply circuit 100 can source 300 milliamperes of current from output terminal 104 to external load 107 at a VOUT of 2.6 volts. In the high power mode, the circuitry of the power supply circuit itself consumes approximately 40 microamperes of current. Approximately 10 microamperes is consumed by operational current amplifier 115. To place power supply circuit 100 into the high power mode, the signal ENABLE appearing at the bottom left of the circuit of FIG. 3 is set at a digital high. In one embodiment, the ENABLE signal is the digital value output by a bit of a register. The ENABLE signal is set high by writing a digital one to the register bit.

In the low power mode, the current control loop portion of power supply circuit 100 is disabled. Operational current amplifier 115 is disabled and second pass transistor M2 is controlled so that it does not supply current to output node 103. In this mode, power supply circuit 100 can source a maximum of approximately two milliamperes of current from output terminal 104 to external load 107 at a VOUT of 2.6 volts. In the low power mode, the circuitry of the power supply circuit itself consumes approximately 11 microamperes of current. The operational current amplifier 115 consumes almost no current. To place the power supply circuit 100 into the low power mode, the signal ENABLE appearing at the bottom left of the circuit of FIG. 3 is set at a digital low. In the embodiment where there is an ENABLE bit in a writable resister, this ENABLE bit is set low by writing a digital zero to the register bit. The register in this embodiment is a register that is writable from an SBI (Serial Bus Interface) or SSBI (Single wire Serial Bus Interface) bus within a cellular telephone.

Pass Transistor Sizing

The size of second pass transistor M2 versus the size of first pass transistor M1 can be determined using a first ratio $N_v=IL_v/IL_v'$ and a second ratio $N_c=IL_c/IL_c'$. These ratios determine the amount of the first current $IL_v$ that flows through first pass transistor M1 versus the amount of the second current $IL_c$ that flows through second pass transistor M2. The relationship between the first current $IL_v$ and the second current $IL_c$ is defined by Equation (1) below.

$$IL = IL_v + IL_c = \frac{N_v + N_c}{N_v} IL_v = \frac{N_v + N_c}{N_c} IL_c \tag{1}$$

A ratio N is defined in Equation (2) to be the size of the second pass transistor M2 divided by the size of the first pass transistor M1.

$$N = \frac{IL_c}{IL_v} = \frac{N_c}{N_v} = \frac{W_c}{L_c}\frac{L_c'}{W_c'}\frac{L_v}{W_v}\frac{W_v'}{L_v'} \tag{2}$$

In Equation (2), $L_v$ is the length of the first pass transistor M1, $W_v$ is the width of the first pass transistor, $L_c$ is the length of the second pass transistor M2, $W_c$ is the width of the second pass transistor M2, $L_c'$ is the length of the second current mirroring transistor M3, $W_c'$ is the width of the second current mirroring transistor M3, $L_v'$ is the length of the first current mirroring transistor M6, and $W_v'$ is the width of the first current mirroring transistor M6. In the example of power supply circuit 100 of FIG. 2, ratio N is approximately 1000. W/L for transistor M1 is 20. W/L for transistor M2 is 20,000.

Loop Stability

Figure 4:
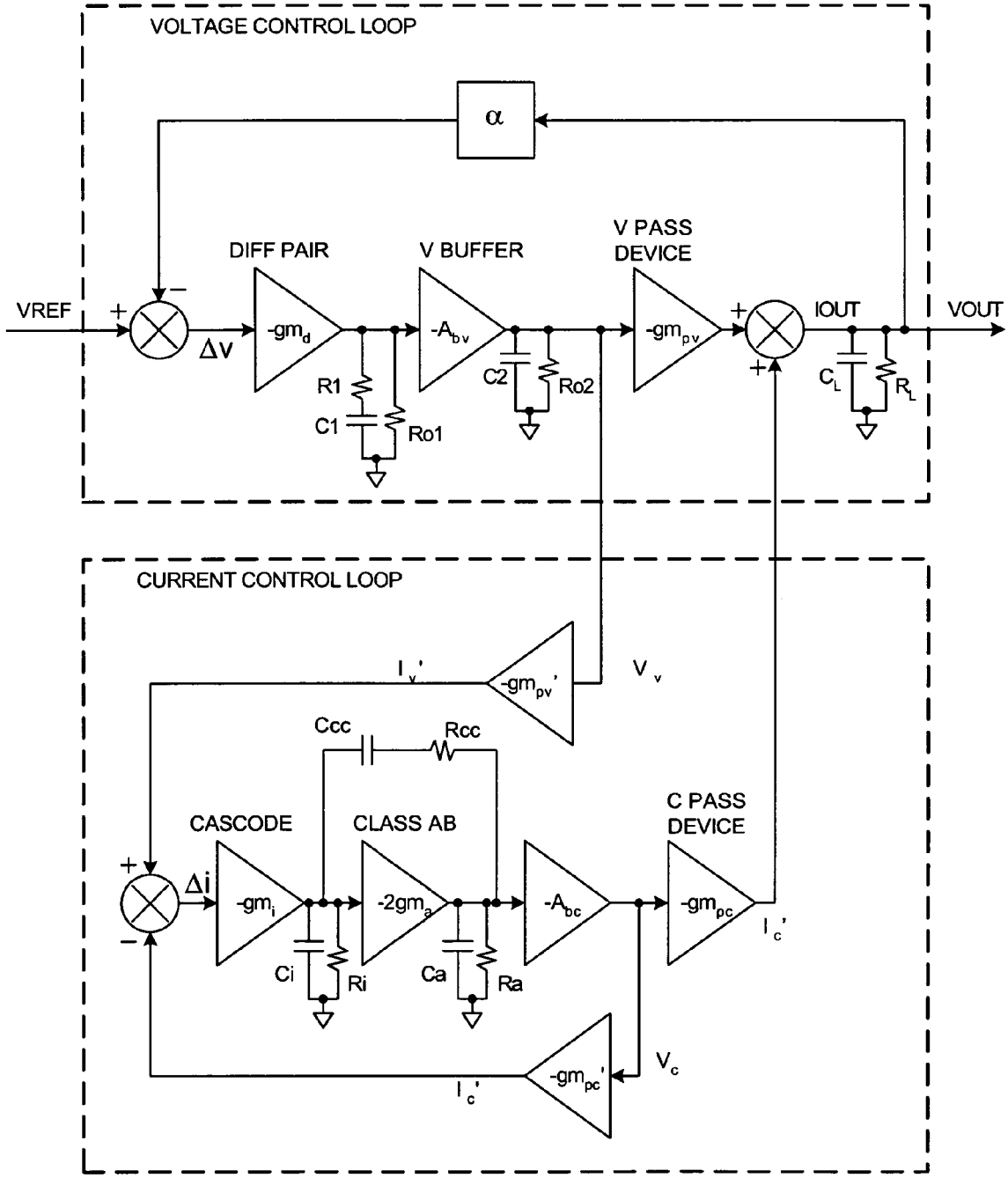
FIG. 4 is a small signal model usable to characterize the operation of the power supply circuit 100 of FIG. 2.

FIG. 4 is a diagram of a small signal model usable to analyze the stability of power supply circuit 100 of FIG. 2.

There are two control loops to be stabilized: the voltage control loop and the current control loop. The stability of each loop can be studied by opening the loop being studied and closing the other loop.

Stabilizing the voltage control loop with respect to load current flowing out of output terminal 104 is facilitated by making first current $IL_v$ a small fraction of second current $IL_c$. The voltage control loop can be any kind of voltage loop such as, for example, a nested Miller capacitance loop, a pole tracking loop, or a zero tracking loop. The example of power supply circuit 100 of FIG. 2 employs a pole tracking voltage loop in order to obtain a better PSRR (a larger negative PSRR number).

Capacitance 117 and transistor 118 in power supply circuit 100 of FIG. 2 together form a compensation circuit 119. Compensation circuit 119 adds a pole and a zero to the voltage control loop, thereby improving the phase margin of the voltage control loop. The voltage control loop has three poles and one zero. Starting at zero hertz and going up in frequency, the poles and the zero occur in the following order: a first pole, a second pole, the zero, and a third pole.

The first pole is due principally to the impedance of load 107 and the capacitance of external capacitor 105. In FIG. 4, the impedance is denoted $R_L$ and the capacitance is denoted $C_L$. The second pole is due to principally to the output impedance of differential amplifier 113 and the capacitance on that node. In FIG. 4, the impedance is denoted ro1 and the capacitance is denoted C1. The zero is due principally to the impedance of transistor 119 and to the capacitance of capacitor 117 of compensation circuit 119. In FIG. 4, the impedance is denoted R1 and the capacitance is denoted C1. The third pole is due principally to the total capacitance on the node at the gate of transistors M4 and M1 and the impedance from this node to AC ground. In FIG. 4, the impedance is denoted ro2 and the capacitance is denoted C2.

The zero provided by compensation circuit 119 is affected by transistor 118 on the node at the output of differential amplifier 108. Transistor 118 operates in the linear region and acts as a variable resistance. When the current load on the power supply circuit 100 increases, the first current $IL_v$ increases, and the current $IL_v'$ through transistor M5 increases. The voltage output by differential amplifier 113 therefore also must have increased. The increase in Vgs on transistor 118 however caused the source to drain resistance of transistor 118 to decrease. The decreased impedance on the node at the output of differential amplifier 113 caused the zero to move higher in frequency.

Not only does the zero increase in frequency with increasing power supply circuit load, but so too do the first pole and the third pole move higher in frequency when the current load on the power supply circuit increases. If there is an increased amount of load current, then first current $IL_v$ increases. For more output current to be output from the power supply circuit, the impedance seen by the power supply circuit must have been reduced. This reduced impedance, which gives rise to the first pole, caused the first pole to increase in frequency.

The third pole is due to the impedance on the node at the gate of transistors M1 and M4. The impedance at this node is determined primarily by the input impedance of transistor M4. The total capacitance on this node is primarily due to the combined gate capacitance of transistors M1 and M4. As the load current on the power supply circuit increases, first current $IL_v$ increases. So too does the current $IL_v'$ flowing through transistor M4. The input impedance of transistor M4 therefore must have had a corresponding decrease. The decrease in the impedance on the node at the gate of transistors M1 and M4 serves to move the third pole higher in frequency.

Accordingly, it is seen that the third pole tracks the first pole in frequency as the load current increases. The voltage control loop is therefore said to have a pole tracking characteristic. Similarly, it is seen that the zero tracks the first pole in frequency as the load current increases. The voltage control loop is therefore said to have a zero tracking characteristic. By providing zero that moves up in frequency with increasing power supply load, the third pole is pushed to higher frequencies. This prevents the phase margin of power supply circuit 100 from being reduced in high current load conditions. If power supply circuit 100 had less noise margin, then a pulse of current drawn from the output terminal 104 might result in a ringing in the output voltage VOUT output onto output terminal 104. By keeping the phase margin of power supply circuit 100 high, the ringing is reduced or eliminated.

Figure 5:
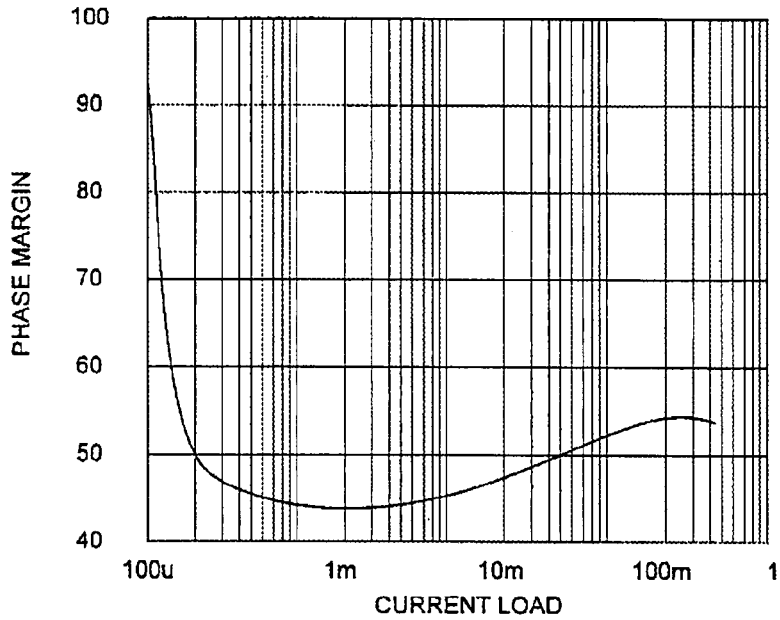
FIG. 5 is a graph that shows the stability of the voltage control loop of power supply circuit 100 of FIG. 2.

FIG. 5 is a diagram illustrating a simulation of the voltage loop when the current loop is closed.

The stability of the current control loop can also be studied with reference to the model of FIG. 4. The current control loop should have a high gain bandwidth (GBW) value so that the loop can react to stimuli quickly. The example of power supply circuit 100 of FIG. 2 therefore employs an operational current amplifier (OCA) inside the current control loop. The current control loop includes three poles and a zero. Starting at zero hertz and going up in frequency, the poles and the zero occur in the following order: a first pole, a second pole, the zero, and a third pole. The first pole is the same pole as the first pole in the voltage control loop. It is determined by the impedance of the load 107 and the capacitance of external capacitor 105. This impedance and capacitance is represented in FIG. 4 by $C_L$ and $R_L$. The second pole is determined by the impedance on the output of the first stage 120 of OCA 115 and by the capacitance on the output of the first stage 120 of OCA 115. In FIG. 4, this impedance is denoted Ri and this capacitance is denoted Ci. The zero is provided by additional components provided within the OCA 115 of FIG. 2. In FIG. 4, these additional components are denoted Rcc and Ccc. Unlike the zero in the voltage control loop, this zero added to the current control loop does not move up in frequency with increasing current load on the power supply circuit. The third pole of the current control loop is determined by the output impedance of the second stage 121 of the OCA 115 and by the capacitance on the output of the second stage 121 of the OCA 115. In FIG. 4, this impedance is denoted Ra and this capacitance is denoted Ca.

Figure 6:
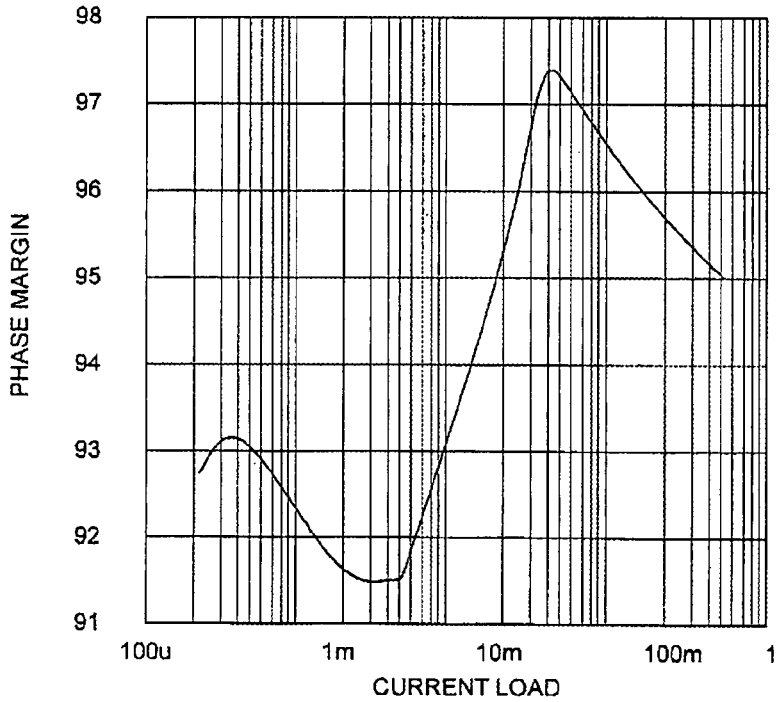
FIG. 6 is a graph that shows the stability of the current control loop of power supply circuit 100 of FIG. 2.

FIG. 6 is a diagram illustrating a simulation of the current loop when the voltage loop is closed.

Parameter Improvement

Equation (3) below is an equation for the DC transfer function of power supply circuit 100. In the equation, $gm_{pv}$ is the transconductance of first pass transistor M1. $A_{bv}$ is the gain of the buffer consisting of N-channel pull-down transistor M5 and P-channel pull-up transistor M4. $Z_L$ is the impedance of load 107. $gm_d$ is the transconductance of differential amplifier 113. $\alpha$ is the ratio of the resistors 110 and 111 of resistor divider 109. $Z_c$ is the impedance at the node at the output of differential amplifier 113. $gm_c$ is the transconductance of second pass transistor M2. $A_{bc}$ is the gain of the buffer consisting of N-channel pull-down transistor M7 and P-channel pull-up transistor M8. B is the gain of operational current amplifier 115. $r_{ds}$ is the output impedance of operational current amplifier 115.

$$VOUT = \frac{Z_L gm_{pv} A_{bv} gm_d Z_c \left( \frac{gm_{pc} A_{bc} \frac{Br_{ds}}{N_v}}{1 - gm_{pc} A_{bc} \frac{Br_{ds}}{N_c}} \right)}{1 + \alpha Z_L gm_{pv} A_{bv} gm_d Z_c \left( 1 - \frac{gm_{pc} A_{bc} \frac{Br_{ds}}{N_v}}{1 - gm_{pc} A_{bc} \frac{Br_{ds}}{N_c}} \right)} VREF \quad (3)$$

The value $(gm_{pc})(A_{bc})(Br_{ds}/N_c)$ is the gain of the current control loop. If the gain of the current control loop $(gm_{pc})(A_{bc})(Br_{ds}/N_c)$ is much greater than one, then $$VOUT = \frac{Z_L gm_{pv} A_{bv} gm_d Z_c \left(1 + \frac{N_c}{N_v}\right)}{1 + \alpha Z_L gm_{pv} A_{bv} gm_d Z_c \left(1 + \frac{N_c}{N_v}\right)} VREF \quad (4)$$

The coefficient $(1+N_c/N_v)$ in Equation (4) has the effect of increasing the closed loop gain of the voltage control loop. The closed loop gain is the quantity that appears to the right of the equal sign and to the left of VREF. The coefficient $(1+N_c/N_v)$ acts as a multiplier that multiplies the transconductance $gm_{pv}$ of first pass transistor M1. The coefficient makes it possible to size first pass transistor M1 to the minimum size required to provide the desired total load current $IL_v$. Once first pass transistor M1 has been sized, then the coefficient $(1+N_c/N_v)$ is chosen to increase the voltage loop gain that depends on the transconductance of first pass transistor M1 such that the following parameters are optimized: 1) PSRR at high frequencies, 2) load regulation, 3) line regulation, 4) overshoot and undershoot.

Equivalent Pass Transistor

Figures 7, 9:
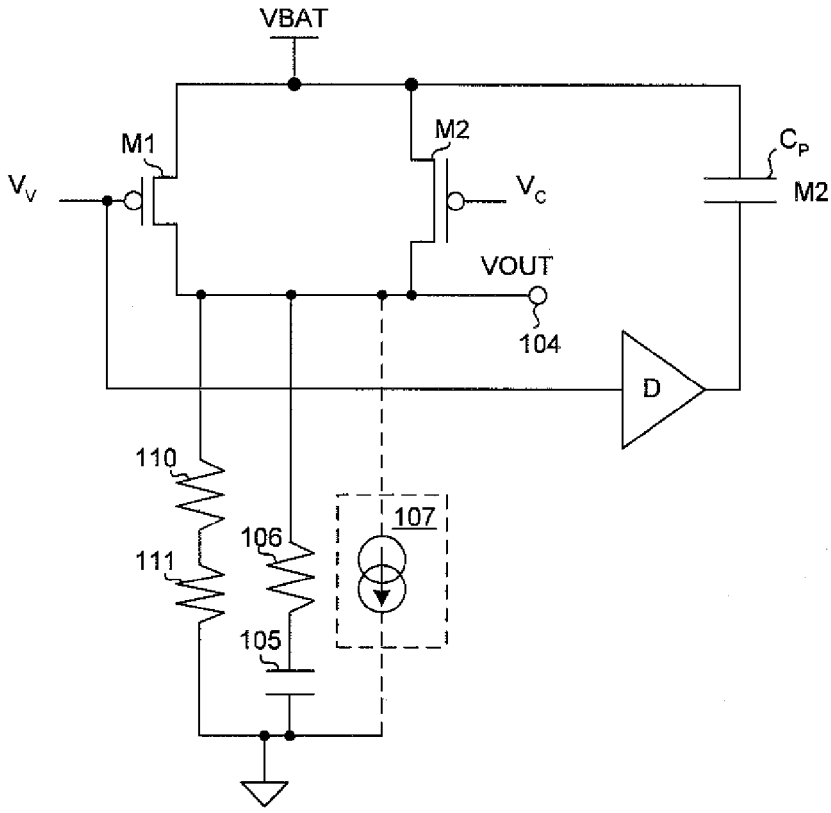
FIG. 7 is a diagram usable to determine the sizing of transistors M1 and M2.
FIG. 9 is a table that sets forth performance parameters of power supply circuit 100 of FIG. 2.

FIG. 7 is a diagram usable to determine how large pass transistor 12 would have to be in the prior art circuit of FIG. 1 in order to have the performance characteristics of power supply circuit 100 of FIG. 1. The equivalent transconductance gm of the combined pass transistors M1 and M2 in the power supply circuit 100 of FIG. 2 is determined by examining the relation of the gate voltage of pass transistor M1 to the gate voltage of pass transistor M2. The gate voltage of first pass transistor M1 is denoted $V_v$. The gate voltage of the second pass transistor M2 is denoted $V_c$. Equation (5) below compares the gate voltages of pass transistors M1 and M2 in the circuit of FIG. 7.

$$\frac{V_c}{V_v} = \frac{-A_{bc} Br_{ds} GM'_v}{1 - A_{bc} Br_{ds} gm'_c} \approx \frac{gm'_v}{gm'_c} = D \quad (5)$$

It is recognized that quantity D is the ratio between the size of transistor M4 and transistor M3. Quantity D is therefore given by Equation (6) below, provided that transistors M5 and M6 are the same size.

$$D = \frac{W'_v}{L'_v} \frac{L'_c}{W'_c} \quad (6)$$

Rearranging and using the ratio N determined above in equation (2), yields Equation (7) below.

$$\frac{N}{D} = \frac{W_c}{L_c} \frac{L_v}{W_v} \quad (7)$$

The transconductance gm of the combined pass transistor (M1 and M2) is given by Equation (8) below.

$$gm = gm_v + gm_c D \quad (8)$$

The load regulation of power supply circuit 100 is therefore expressed by Equation (9) below.

$$\frac{\Delta VOUT}{\Delta IOUT} = \frac{1}{(gm_v + gm_c D) A_{bv} gm_d Z_c \alpha} \quad (9)$$

The line regulation of power supply circuit 100 is therefore expressed by Equation (10) below.

$$\frac{\Delta VOUT}{\Delta IOUT} = \frac{(gm_v + gm_c)}{(gm_v + gm_c D) A_{bv} gm_d Z_c \alpha} \quad (10)$$

In Equations (9) and (10), note that the quantity D acts as a transconductance amplification factor. To increase the transconductance of pass transistor 12 in the prior art circuit of FIG. 1, the size of pass transistor 12 was increased. To a first approximation, the relationship between transconductance and transistor size is linear in the prior art circuit.

In the power supply circuit 100 of FIG. 2, on the other hand, the quantity D acts to amplify the transconductance $gm_c$ of second pass transistor M2. Power supply circuit 100 has superior load regulation and line regulation characteristics in comparison to the prior art circuit of FIG. 1, and simultaneously reducing the amount of die space consumed by pass transistors M1 and M2 in comparison to the amount of die space consumed by pass transistor 12 of the prior art power supply circuit of FIG. 1. Whereas the W/L of transistor 12 in the prior art circuit of FIG. 1 is 120,000, the W/Ls of transistors M1 and M2 in power supply circuit 100 are 20 and 20,000, respectively.

For low values of load current $I_L$, transconductance $gm_v'$ can be much higher than transconductance $gm_c'$ because the current in transistor M3 is low. The open loop gain can be high and difficult to stabilize. Accordingly, in conditions in which power supply circuit 100 is sourcing low amounts of load current to output terminal 104, the current loop may be disabled in certain embodiments. Another way to increase D is to add a leakage current in parallel with transistor M3. This leakage current allows current to flow in the current loop in low load current situations.

Over/Undershoot Improvement

The overshoot ΔVOUT can be expressed by Equation (11) below.

$$\Delta VOUT = \frac{2\sqrt{2}}{gm_{pIL}} \frac{C_p}{C_L} \frac{I_L^2}{I_{op}} + R_{esr} I_L \quad (11)$$

Cp is the capacitance of second pass transistor M2. $I_{op}$ is the bias current of the operational current amplifier 115. $gm_{pIL}$ is the transconductance of second pass transistor M2 at maximum load current $I_L$. $C_L$ is the capacitance of external load capacitor 105. $R_{esr}$ is the parasitic series resistance 106 of external load capacitor 105.

In order to reduce overshoot, a small $C_p$ and a small $R_{esr}$ is desired. With a repeatable and known $R_{esr}$ of a ceramic capacitor $C_L$, it is possible to use the intrinsic zero ($\frac{1}{2}\pi R_{esr} C_L$) to stabilize the voltage control loop. The overshoot, however, will be higher than if the power supply circuit were stabilized with a titanium capacitor having an $R_{esr}$ close to zero. Simulation results show that the combination of the voltage control loop and current control loop makes it possible to use both kinds of capacitors, ceramic and titanium.

Power Supply Rejection Ratio

Figure 8:
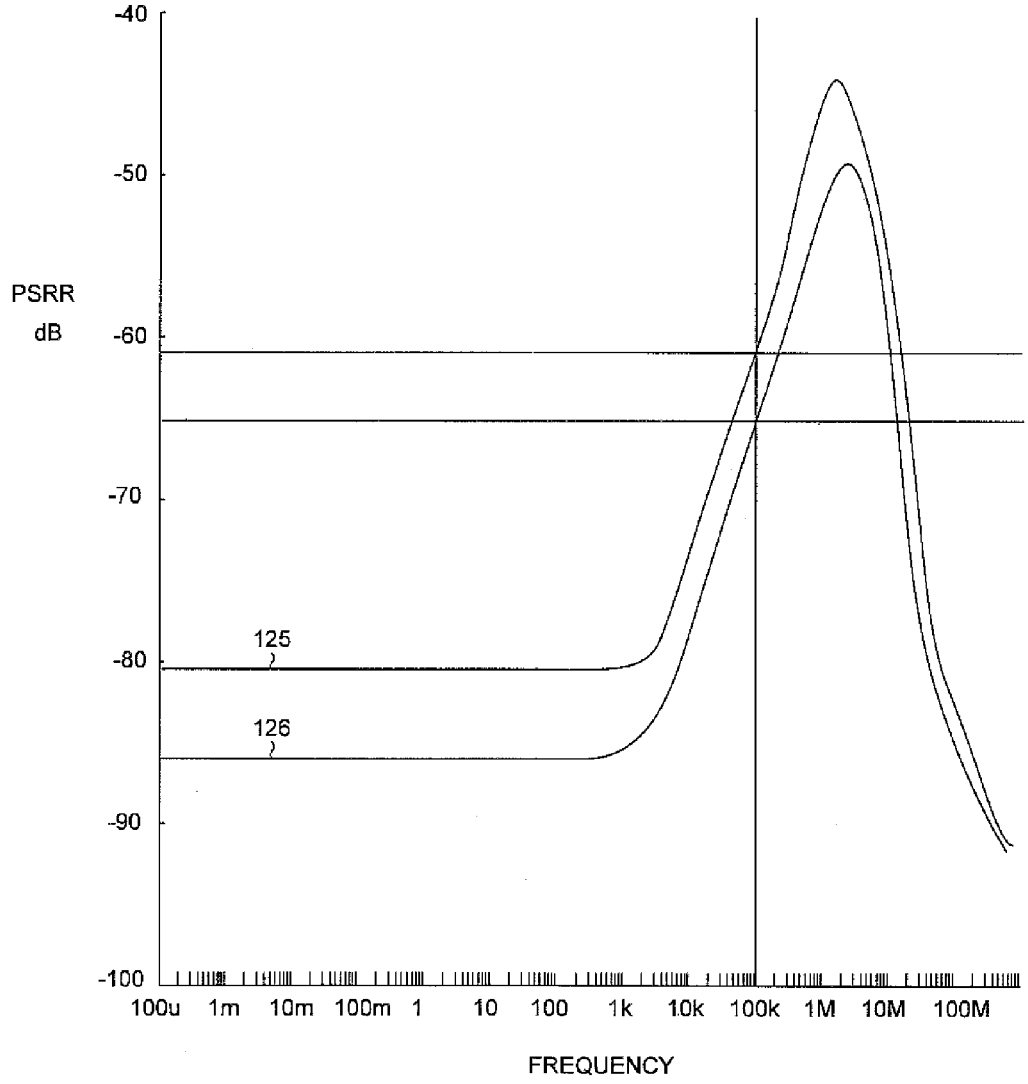
FIG. 8 is a graph of how the power supply rejection ratio (PSRR) of the power supply circuit 100 of FIG. 2 changes with frequency.

FIG. 8 is a graph of the power supply rejection ratio (PSRR) of power supply circuit 100 of FIG. 2 versus frequency. Curves 125 and 126 bound the operation of power supply circuit 100 for operating conditions within a temperature range and a process variation range. The curves 125 and 126 indicate variations in PSRR of about 5 dB at 100 kHz. The PSRR is better than −65 dB (the PSRR is a bigger negative number) for frequencies lower than 100 kHz Performance Parameters FIG. 9 is a table that sets forth several performance parameters of the power supply circuit 100 of FIG. 2. In the first row, the value IDDQ is the amount of current consumed by the power supply circuit 100 itself, independent of any current being sourced by the power supply circuit to a load. The value LPM is the current consumed in the low power mode. The value HPM is the current consumed in the high power mode. The value LOAD is a percentage of the full load current supplied to the load (in this case, 300 milliamperes) that is consumed by the power supply circuit itself.

In the second row, the value LOAD REG is the load regulation. This quantity is an indication of how much the output voltage drops when the current sourced by the power supply circuit is increased from its minimum value (in this case, zero milliamperes) to its maximum rated value (in this case, 300 milliamperes). The percentage value is a measure of the magnitude of the output voltage drop versus the full output voltage value of 4.0 volts.

In the third row, the value LINE REG is the line regulation. This quantity is an indication of how the output voltage drops if the battery voltage VBAT is made to drop from 4.0 volts.

In the fourth row, the power supply rejection ratio (PSRR) for input variations of zero Hz is set forth.

In the fifth row, the PSRR for input variations of 100 kHz is set forth.

In the sixth row, the DC error value is an indication of how close the output voltages of different power supply circuit 100 units are to the desired 2.6 volt output over temperature and process variations.

In the seventh row, the value DROPOUT is a value that indicates how much higher the battery voltage VBAT must be over the desired output voltage (in this case, 2.6 volts). If VBAT drops to a value less than the desired output voltage plus the DROPOUT value, then the desired output voltage (for example, 2.6 volts) will not be maintained on power supply circuit output terminal 104

In the eighth row, the width over length ratio of the combined pass transistor is set forth. Second pass transistor M2 is approximately 1000 times as large as first pass transistor M1. The ratio is therefore the ratio of second pass transistor M2. First pass transistor M1 is ignored. Second pass transistor M2 is approximately 14 mm wide, by 0.7 microns long, and has a W/L of approximately 20,000. The W/L of first pass transistor M1 is approximately 20.

Although certain specific embodiments are described above for instructional purposes, the present invention is not limited thereto. The power supply circuit is usable to supply power to a circuit or to supply power to a rechargeable battery during recharging. Accordingly, various modifications, adaptations, and combinations of the various features of the described specific embodiments can be practiced without departing from the scope of the invention as set forth in the claims.

What is claimed is:

1. A power supply circuit, comprising:

an output node;

a first pass transistor;

a voltage control loop that controls the first pass transistor such that the first pass transistor supplies a first current to the output node, wherein a control current different from the first current is flowing in a portion of the voltage control loop;

a second pass transistor; and a current control loop that generates a second current, the second current having a magnitude that is at least 500 times as large as the first current and that is proportional to a magnitude of the control current flowing in the voltage control loop, the second current being supplied by the second pass transistor to the output node.

2. The power supply circuit of claim 1, wherein the voltage control loop controls the first pass transistor such that a predetermined output voltage is present on the output node, wherein the first current and the second current together are a load current, and wherein the magnitude of the second current is not proportional to the magnitude of the control current when the load current is less than approximately one milliampere.

3. The power supply circuit of claim 2, wherein the voltage control loop comprises:

a voltage divider that receives the predetermined output voltage from the output node and outputs a sense voltage onto a voltage divider node;

a voltage reference that outputs a reference voltage onto a reference voltage node;

a differential amplifier having a first input lead, a second input lead, and an output lead, the first input lead being coupled to the voltage divider node, the second input lead being coupled to the reference voltage node; and a transistor having a control terminal, the control terminal being coupled to the output lead of the differential amplifier, wherein the control current is a current flowing through the transistor.

4. The power supply circuit of claim 1, wherein the current control loop comprises:

a first current mirroring transistor that mirrors the control current flowing in the voltage control loop such that a first mirror current flows through the first current mirroring transistor;

a second current mirroring transistor that mirrors the second current such that a second mirror current proportional to the second current flows through the second current mirroring transistor, the second current mirroring transistor having a control terminal that is coupled to a control terminal of the second transistor; and control circuitry that controls a voltage on the control terminal of the second current mirroring transistor and on the control terminal of the second transistor such that the second mirror current flowing through the second current mirroring transistor is substantially equal to the first mirror current flowing through the first current mirroring transistor.

5. The power supply circuit of claim 4, wherein the control circuitry comprises an operational current amplifier (OCA), the operational current amplifier having an input lead, and wherein the first current mirroring transistor has a drain terminal that is coupled to the input lead of the operational current amplifier and to a drain of the second current mirroring transistor.

6. The power supply circuit of claim 1, wherein the first and second pass transistors are both disposed on an integrated circuit, the first pass transistor occupying a first amount of die space, the second pass transistor occupying a second amount of die space, the second amount of die space being at least 500 times larger than the first amount of die space.

7. The power supply circuit of claim 1, wherein the power supply circuit is operable in a first mode and a second mode, wherein the current control loop is enabled in the first mode such that the second current is supplied by the second pass transistor to the output node, and wherein the current control loop is disabled in the second mode such that the second pass transistor supplies substantially no current to the output node.

8. The power supply circuit of claim 7, further comprising:

a register bit that outputs a digital signal, wherein if the digital signal has a first digital value then the current control loop is enabled, whereas if the digital signal has a second digital value then the current control loop is disabled.

9. The power supply circuit of claim 8, wherein the register bit is part of an integrated circuit, wherein the integrated circuit has a serial bus interface, and wherein the register bit is writable using the serial bus interface.

10. The power supply circuit of claim 1, wherein the voltage control loop controls the first pass transistor such that the power supply circuit sources at least 300 milliamperes from the output node, the power supply circuit receiving a supply voltage from a power source, the power supply circuit having a power supply rejection ratio (PSRR) of better than −60 dB for frequency variations in the supply voltage throughout a range of 0 Hz to 100 kHz.

11. The power supply circuit of claim 1, wherein the first pass transistor, the voltage control loop, the second pass transistor, and the current control loop together to form a means for receiving a supply voltage and for supplying an output voltage onto the output node with a power supply rejection ratio (PSRR) of better than −60 dB for frequency variations in the supply voltage throughout a range of 0 Hz to 100 kHz.

12. The power supply circuit of claim 11, wherein the power supply circuit is integrated onto a first integrated circuit die, wherein the power supply circuit supplies a current from the output node, the current flowing into a second integrated circuit die, the first integrated circuit die and the second integrated circuit die being parts of a cellular telephone.

13. A method, comprising:

conducting a first current through a first transistor from a voltage supply terminal to an output terminal;

using a first control loop to control the first transistor such that a voltage on the output terminal is regulated to a predetermined output voltage;

conducting a second current through a second transistor from the voltage supply terminal to the output terminal; and using a second control loop to control the second transistor such the second current is a large multiple of the first current.

14. The method of claim 13, wherein the large multiple is at least 500, wherein a supply voltage is present on the voltage supply terminal, and wherein the large multiple remains substantially constant for variations in the supply voltage throughout a frequency range of from 0 Hz to 100 kHz.

15. The method of claim 14, wherein the first transistor, first control loop, second transistor, second control loop, voltage supply terminal and output terminal are parts of a power supply circuit, and wherein the power supply circuit supplies current through the voltage supply terminal to an integrated circuit.

16. The method of claim 14, wherein the first transistor, first control loop, second transistor, second control loop, voltage supply terminal and output terminal are parts of a power supply circuit, the power supply circuit being integrated onto a first integrated circuit, and wherein the power supply circuit supplies current from its output terminal to a second integrated circuit, the first and second integrated circuits being parts of a cellular telephone.

17. The method of claim 14, further comprising:

disabling the second control loop such that the second current is substantially zero and such that the first control loop continues to regulate the voltage on the output terminal to the predetermined output voltage.

18. The method of claim 14, wherein the first transistor, first control loop, second transistor, second control loop, voltage supply terminal and output terminal are parts of a power supply circuit, the power supply circuit being powered by a supply voltage present on the voltage supply terminal, the power supply circuit having a power supply rejection ratio (PSRR) better than −60 bB for variations in the supply voltage throughout the frequency range of from 0 Hz to 100 kHz.

19. The method of claim 14, wherein the second transistor is at least 500 times as large as the first transistor.

20. The method of claim 14, wherein the voltage supply terminal is coupled to a battery.

21. The method of claim 14, wherein the output terminal is coupled to a rechargeable battery.

22. A power supply circuit, comprising:

a voltage supply terminal, a supply voltage being present on the voltage supply terminal;

an output node;

a transistor;

a voltage control loop that controls the transistor such that the transistor conducts a first current from the voltage supply terminal to the output node, wherein a control current is flowing in a portion of the voltage control loop and is not flowing through the transistor; and means for conducting a second current from the voltage supply terminal to the output node, the second current having a magnitude that increases if the first current increases and that decreases if the first current decreases, the means controlling the second current such that the power supply circuit has a power supply rejection ratio (PSRR) better than −60 bB for variations in the supply voltage throughout a range of from 0 Hz to 100 kHz, wherein at least the transistor and the means are integrated onto an integrated circuit.

23. The power supply circuit of claim 22, wherein the power supply circuit is operable in a first mode and a second mode, and wherein in the second mode the means is disabled such that the second current is substantially zero, the voltage control loop regulating the first current in the second mode such that a predetermined output voltage is present on the output node.

24. The power supply circuit of claim 22, wherein the means includes an operational current amplifier (OCA).

25. The power supply circuit of claim 22, wherein the second current varies in proportion to the first current, and wherein the second current is at least 500 times as large as the first current.

* * * * *